United States Patent [19]

Furuya

[11] 4,319,597

[45] Mar. 16, 1982

[54] CURRENCY HANDLING MACHINE

[75] Inventor: Katusuke Furuya, Tokyo, Japan

[73] Assignee: Laurel Bank Machine Co., Ltd., Tokyo, Japan

[21] Appl. No.: 191,960

[22] Filed: Sep. 29, 1980

Related U.S. Application Data

[63] Continuation of Ser. No. 964,429, Nov. 28, 1978, abandoned.

[30] Foreign Application Priority Data

Jun. 3, 1977 [JP] Japan ..... 52-72385[U]

[51] Int. Cl.[3] ..... B65B 11/04; G07D 9/00

[52] U.S. Cl. ..... 133/8 A; 53/212

[58] Field of Search ..... 133/1 R, 1 A, 8 R, 8 A, 133/8 C; 53/212, 501, 77; 318/663, 664, 667, 665, 674

[56] References Cited

U.S. PATENT DOCUMENTS

| | | | |
|---|---|---|---|
| 3,155,889 | 11/1964 | Stiles et al. | 318/664 X |
| 3,569,815 | 3/1971 | McNaughton | 318/664 X |
| 3,644,892 | 2/1972 | Szymber et al. | 318/664 X |
| 3,789,283 | 1/1974 | Kabat | 318/663 X |
| 3,924,171 | 12/1975 | Ukai et al. | 318/663 |
| 3,938,303 | 2/1976 | Ushio et al. | 53/212 |
| 4,117,386 | 9/1978 | Cohen et al. | 318/664 |

*Primary Examiner*—Robert J. Spar
*Assistant Examiner*—Edward M. Wacyra
*Attorney, Agent, or Firm*—Fleit & Jacobson

[57] ABSTRACT

There is provided a currency handling machine which comprises a setting potentiometer, the movable member of which is rotated to be set by a currency species setting control, a selecting potentiometer, the movable member of which is adapted to be rotated together with one of selected movable members in operation sections, a control circuit to detect a differential potential between the outputs of the setting and selecting potentiometers to issue a driving signal, a driving circuit connected to the control circuit for receiving the driving signal and a motor connected to the driving circuit and adapted to rotate the selected movable members in operation sections in accordance with the driving signal. A rotating direction selecting circuit may be provided for determining the direction of rotation of the motor.

7 Claims, 9 Drawing Figures

CURRENCY HANDLING MACHINE

This is a continuation of application Ser. No. 964,429 filed Nov. 28, 1978, now abandoned.

BACKGROUND OF THE INVENTION

This invention relates to improvements in an apparatus for conducting preparatory operations in accordance with the species of the coins or notes handled by a coin or note handling machine.

In a coin handling machine, it is necessary as preparatory operations to select the species of coin, count the coins, select an accumulating cylinder for a predetermined number of coins, select a packaging paper, determine the level of a clamping pawl to correspond to the level of the accumulated coins, and select stamps for sealing the species of coin, for indicating the amount of money packaged, for indicating the bank name, etc. In a note handling machine, it is necessary to select a storage stacker for notes, etc. and in a money changing machine or a money discharging machine, it is also necessary to make selections or settings as mentioned above.

All countries have currencies consisting of several species of coins and notes. Therefore, in a coin or note handling machine, it is necessary to make selections or settings for the species of coin or note to be treated each time there is a change in the species of the coin or note to be handled. In general, selecting operations are made by selecting switches corresponding in number to the number of species of coins or notes to be handled and cams for actuating one or more of these switches are used to issue signals and actuate necessary motors and solenoids, etc. and thereby to control each mechanism. However, in such an apparatus, the selecting switches become large in number and when many species of coins are to be handled, the machine itself becomes large. As a result, the machine is hard to miniaturize and its assembly and adjustment are difficult. Thus, the machine becomes high in cost.

As an example, the Japanese Utility Model application No. 168475/1976 which was filed by the same applicant discloses that in a coin handling machine many switches are used as a setting device and selecting devices. The coin handling machine requires space for disposing many switches and a number of cams for selectively actuating these switches and thus is attended by difficulties in the adjustment of the timing of each cam.

In these conventional apparatuses, the movable members of the selecting devices are constructed so that they are rotated in the same direction regardless of direction of rotation of a setting dial. Because of this, when a selecting device is set by rotating a setting dial 60° in the opposite direction to that of the movable member of the selecting device, the movable member must be rotated 300° and this results in an unnecessarily long selecting time.

There is known a specific example of a combination of a packaging paper position setting device and a selecting device associated therewith for use in conventional machines. However, in this arrangement, when the carriage having packaging papers mounted in several positions is located by the selecting device, the selecting device relocates the carriage after releasing the carriage from the locked state in which it has previously be placed by a lock device. Such lock devices are generally constructed to be released by energization of a solenoid. Since, in these machines, the electric source is cut off when the cover is opened, it is impossible to manually set the location of the packaging paper when the machine malfunctions.

SUMMARY OF THE INVENTION

It is a primary object of the invention to provide a coin or note handling machine wherein a pair of potentiometers, one which is manually set for the desired species of coin or note and the other for determining the location of the movable member in the selection section, is provided and the location selecting operation is made by the variation of the potential level or resistance value of the potentiometers.

It is an object of the invention to provide a coin or note handling machine wherein settings or selections are made steplessly by means of potentiometers without use of many switches and cams.

It is a further object of the invention to provide a coin or note handling machine which can readily be increased in the number of species of coins or notes it is capable of handling and which is capable of making stepless switchings.

It is a further object of the invention to provide a coin or note handling machine wherein a selecting device can rotate a location selected movable member in either direction following up the rotation of a setting device.

It is a further object of the invention to provide a coin or note handling machine wherein selections can be made in a relatively short time.

It is a further object of the invention to provide a coin handling machine wherein in locating a packaging paper, no release of locking is necessary.

BRIEF DESCRIPTION OF THE DRAWINGS

The invention will be explained with reference to the accompanying drawings in which.

DETAILED DESCRIPTION OF THE PREFERRED EMBODIMENT OF THE INVENTION

The primary concept of the present invention will first be explained with reference to FIGS. 1 and 2 and then as specific examples, a setting device and a selecting device for selecting packaging paper will be explained with reference to FIGS. 3 through 9. Although the devices shown in FIGS. 3 through 9 are illustrated to incorporate the device shown in FIG. 1 they can also incorporate the device shown in FIG. 2. Further, although the devices shown in FIGS. 3 through 9 are directed to ones wherein a selecting device rotates a location selected movable member or carriage in either direction following up the rotation of a setting dial of a setting device, these devices are applicable by small modification of the driving circuit to ones wherein a selecting device rotates a location selected movable member only in one direction.

Figure 1:
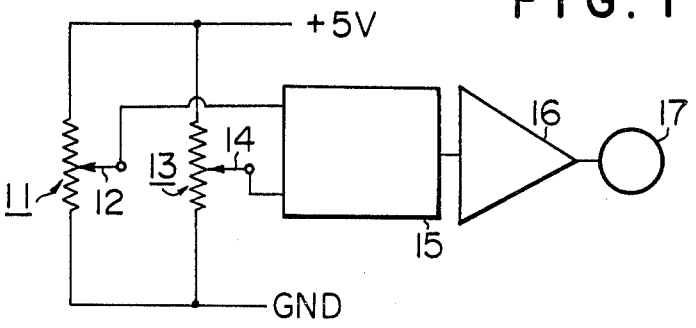
FIG. 1 is a diagram showing one embodiment of a circuit for use in a coin or note handling machine according to the invention.
Figure 2:
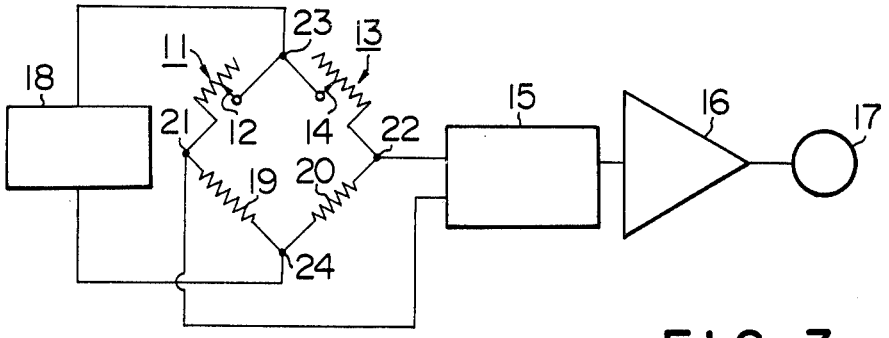
FIG. 2 is a diagram showing another embodiment of a circuit for use in a coin or note handling machine according to the invention.

Referring now to FIGS. 1 and 2, FIG. 1 shows a pair of potentiometers which by their output differential actuate a motor for rotating a selected movable member and FIG. 2 shows a pair of potentiometers which by resistance values actuate a motor for rotating a location selected movable member.

In FIG. 1, a setting potentiometer 11 can set of its potential by moving its movable member 12. The potentiometer 11 is connected to a dial which is not shown in FIGS. 1 and 2, manually set for the desired species of coin or note and, therefore, the movable member 12 can be set to a location corresponding to the desired species of coin or note. A selecting potentiometer 13 has its movable member 14 moved by a location selected movable member, not shown in FIGS. 1 and 2.

In operation, the movable member 12 is set to a predetermined location corresponding to the desired species of coin or note by rotation of the setting dial to determine the output potential. The output potential is applied through a control circuit 15 to a drive circuit 16 to thus start driving a motor 17 for conducting preparatory operations in each operation section. In one of these operations, the movable member 14 is moved. As a result, when the output potential of the selecting potentiometer 13 comes to be consistent with the output potential of the setting potentiometer 11, the drive circuit 16 is again operated through the control circuit 15 to stop the motor 17. At this time, each operation section is ready to handle the desired species of coin or note.

In FIG. 2, an electric bridge is composed of the setting potentiometer 11, the selecting potentiometer 13, a fixed resistor 19 and a fixed resistor 20. The output of an oscillator 18 is applied between junctions 23 and 24 of the bridge. In the case of the circuit of FIG. 2, although the setting potentiometer is set in a similar manner to that of FIG. 1, when the product of the resistance value of the setting potentiometer 11 and the resistance value of the fixed resistor 20 comes to be consistent with the product of the resistance value of the selecting potentiometer 13 and the resistance value of the fixed resistor 19, the differential potential between junctions 21 and 22 becomes zero. Thus, the control circuit 15 issues a stop signal to the drive circuit 16, thereby stopping the rotation of the motor 17. If the resistance values of fixed resistors 19 and 20 are selected to be the same, then when the resistance values of the two potentiometer 11 and 13 come to be the same, the motor is stopped.

The dials shown in FIGS. 1 and 2 are constructed so that the movable member of the selecting potentiometer can be made to rotate only in one direction or to rotate in either direction following up the rotation of the setting dial.

The device according to the present invention constructed as mentioned above can set and select the species of coin or note steplessly without switches, and, therefore is applicable to a wide range of utilization.

Further, the device has no cams and has but little wiring. Consequently, the device can be made to be compact and can be easily adjusted.

As the embodiments associated with the device of FIG. 1, the setting and selecting mechanism wherein the potential variable member of the selecting potentiometer is rotated in either direction following up the rotation of the setting dial will be explained with reference to FIGS. 3 through 9. For clarity of illustration, the explanation of the above-mentioned setting and selecting mechanism will be made for specific embodiments concerning a packaging paper selecting mechanism for use in a coin packaging machine.

Figure 3:
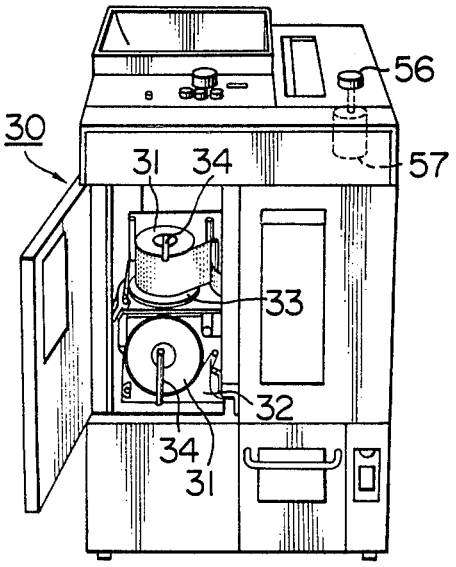
FIG. 3 is a diagrammatical view showing a coin packaging machine which specifically embodies the present invention.
Figure 4:
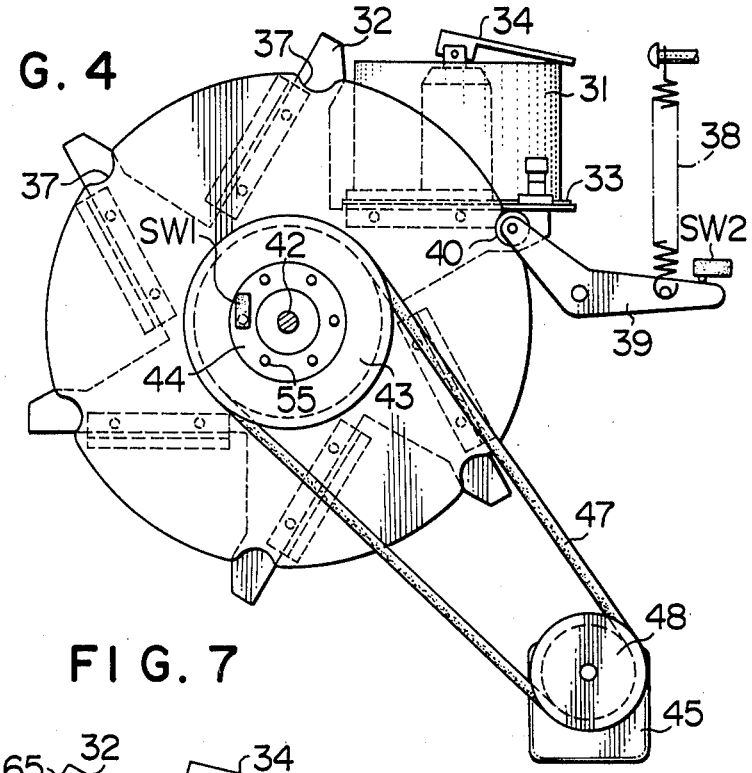
FIG. 4 is a side view showing one embodiment of a packaging paper selecting device for use in a coin packaging machine.

FIG. 3 shows the overall configuration of a coin packaging machine 30 and FIG. 4 shows a packaging paper selecting device for use in the coin packaging machine. A plurality of packaging papers 31 are adapted for packaging a given species of coins. Each paper 31 is attached with the aid of a paper retaining lever 34 to the packaging paper loading device 33 mounted on a location selected movable member or carriage 32. A side wall 36 is attached to the movable member 32 at one side thereof and is formed at the periphery thereof with a plurality of semicircular cut-outs 37 in equally spaced relationship. The number of the cut-outs 37 corresponds to the number of the packaging paper loading device 33 or the species of coins to be selected.

A stopper or stopping lever 39 is pivotably mounted adjacent the movable member 32 and is provided at one end thereof with a roller 40 which is engageable with one of the cut-outs 37 of the side wall 36 and at the other end with a spring 38 for biasing the stopper 39 anticlockwise. An engagement detecting microswitch SW2 is disposed adjacent the other end of the stopper 39 and is adapted to be actuated to open its contacts when the roller 40 is completely engaged with one of the cut-outs 37.

The movable member 32 is attached to a shaft 42, and a pulley 43 and a timing cam 44 are also attached to the shaft 42. The pulley 43 is engaged with a belt 47 which in turn is engaged with a pulley 48. The pulley 48 is connected to a setting motor 45. Therefore, the movable member 32 is rotated through the pulley 48, the belt 47 and the pulley 43 by the motor 45.

Figure 5:
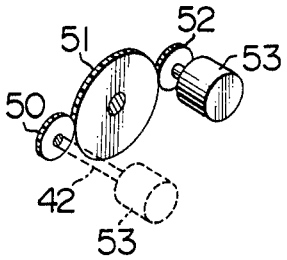
FIG. 5 is a perspective view showing a motor for selecting packaging paper for use in a coin packaging machine.

A gear 50 is also attached to the shaft 42 as shown in FIG. 5. The gear 50 drives a gear 52 through a gear 51 and the amount of rotation of the gear 52 is thus detected by a selecting potentiometer 53. That is, the movable member, not shown, of the selecting potentiometer 53 is moved or rotated to vary its out-put potential. The selecting potentiometer 53 may be directly connected to the shaft 42 as shown by dotted lines of FIG. 5. The timing cam 44 is provided in equally spaced relationship with a plurality of projections 55 which are adapted to actuate a timing microswitch SW1 to open its contacts. The number of the projections 55 corresponds to the number of the species of coins.

A setting dial 56 for manually setting to the desired species of coin is provided on a console on the top of the machine. A setting potentiometer 57 is connected to the setting dial 56. The movable member, not shown, of the setting potentiometer 57 is set by moving or rotating the same to vary its out-put potential.

Figure 6:
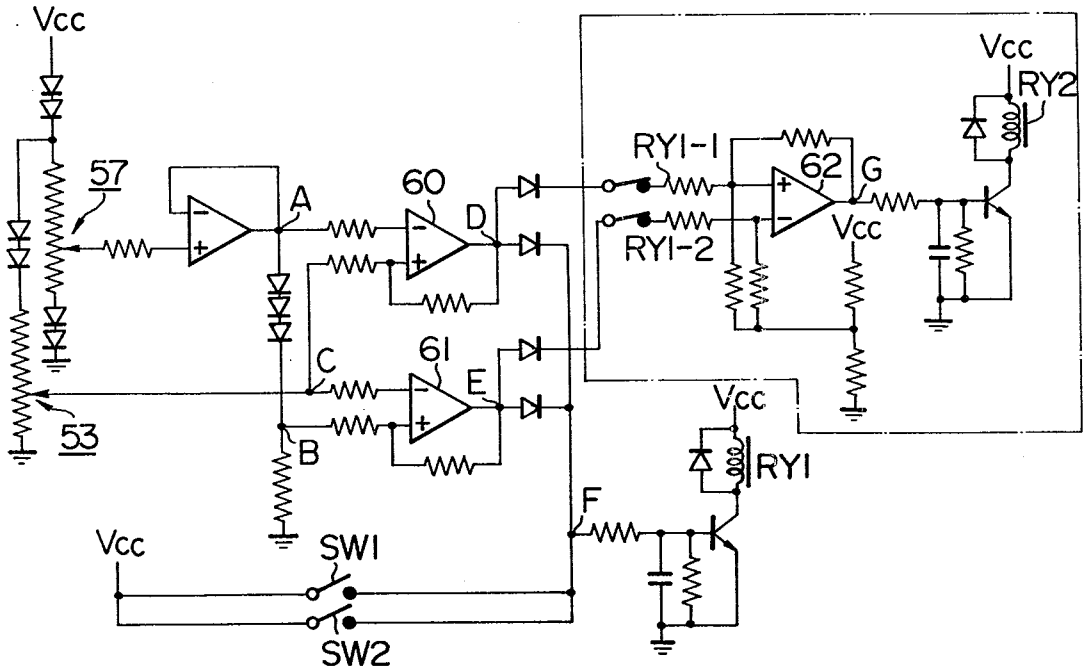
FIG. 6 is a diagram showing a circuit used together with the packaging paper selecting device of FIG. 4.

FIG. 6 shows a driving circuit for the selecting mechanism shown in FIG. 4. As mentioned above, the driving circuit utilizes the differential potential as shown in the device of FIG. 1. The selecting mechanism shown in FIG. 4 and its driving circuit shown in FIG. 6 are illustrated to be in a stopped state. When the potentials at A, B and C are representative of the relation between the output potentials of the two potentiometers 57 and 53, A potential is greater than C potential and C potential is greater than B potential. Due to the voltage drop across the diodes between A and B points, A potential is always greater than B potential. From the fact that A potential is greater than C potential, the output of an operational amplifier 60 at D point is at a low level and, in a similar manner, from the fact that C potential is greater than B potential, the output of an operational amplifier 61 at E point is also at a low level. The contacts of the timing microswitch SW1 and the engagement detecting microswitch SW2 open since they are actuated. Therefore, the potential at F point is also at a low level and, therefore, a setting motor driving relay RY1 is not actuated and the setting motor 45 therefore stops.

If the movable member of the setting potentiometer 57 is manually rotated through the dial 56 by such an amount from the above-mentioned stopped state as to lower the potentials at A and B points, that is, if C potential becomes greater than the A potential, the potential at D point becomes high and, therefore, the potential at F point also becomes high. Consequently, the relay RY1 is actuated to start the rotation of the motor 45. Although, the relay RY1 opens its contacts RY1-1 and RY1-2 which are portions of the contacts, an operational amplifier 62 is actuated by the output potential level at D and E points and held during the time lag between the initial state (or non-actuation) and the actuation of the relay RY1. Therefore, in this instance, since the D potential is at a high level, the G potential becomes high in level and thus a rotating direction selecting relay RY2 is actuated to determine the rotation of the motor. Consequently, for example, the movable member 32 is rotated in a clockwise direction.

As the movable member 32 rotates, the output potential of the selecting potentiometer 53 at C point is lowered. When the C potential becomes less than the A potential, the D potential becomes low in level. That is, the C potential becomes less than the A potential and greater than the B potential and the movable member 32 is selected at an angle of rotation corresponding to the C potential between the A and B potentials. Thereafter, the timing microswitch SW1 is actuated by one of the projections 55 to open its contacts and the engagement detecting microswitch SW2 is also actuated by complete engagement of one of cut-outs 37 and the roller 40 to open its contacts. Consequently, the F potential becomes low in level and, therefore the relay RY1 is deenergized to stop the motor 45. Further, the motor may be provided with a brake circuit for braking the motor in stopping. The amount (or the angle) of rotation of the movable member 32 is preferably substantially equal to that of the setting dial.

In a similar manner, when the setting potentiometer 57 is set to a higher potentials by rotating the setting dial, the A potential becomes greater than the C potential and the B potential also becomes greater than the C potential. Therefore, the E potential becomes high in level and the output of the operational amplifier 62 at the G point becomes low in level. Consequently, the movable member 32 is rotated in a direction opposite to that of the previous case. Therefore, for example, the movable member 32 is rotated anticlockwise and finally comes to the desired location. It should be noted that when the setting dial is rotated in one direction, the movable member is rotated in a direction corresponding to the direction of rotation of the setting dial and when the setting dial is rotated in the other direction, the movable member is rotated in the other direction corresponding to the other direction of rotation of the setting dial, that is, whichever direction the setting dial is rotated, the movable member is rotated in the same direction following up the rotation of the setting dial. This means that the movable member rotates in the same direction as that of the setting dial.

Figure 7:
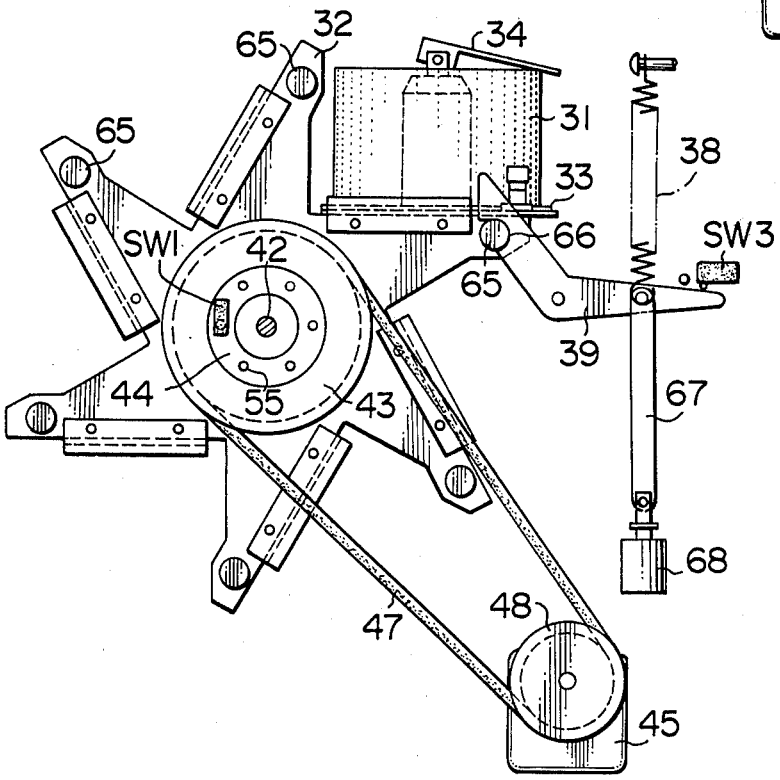
FIG. 7 is a side view showing another embodiment of a packaging paper selecting device.
Figure 8:
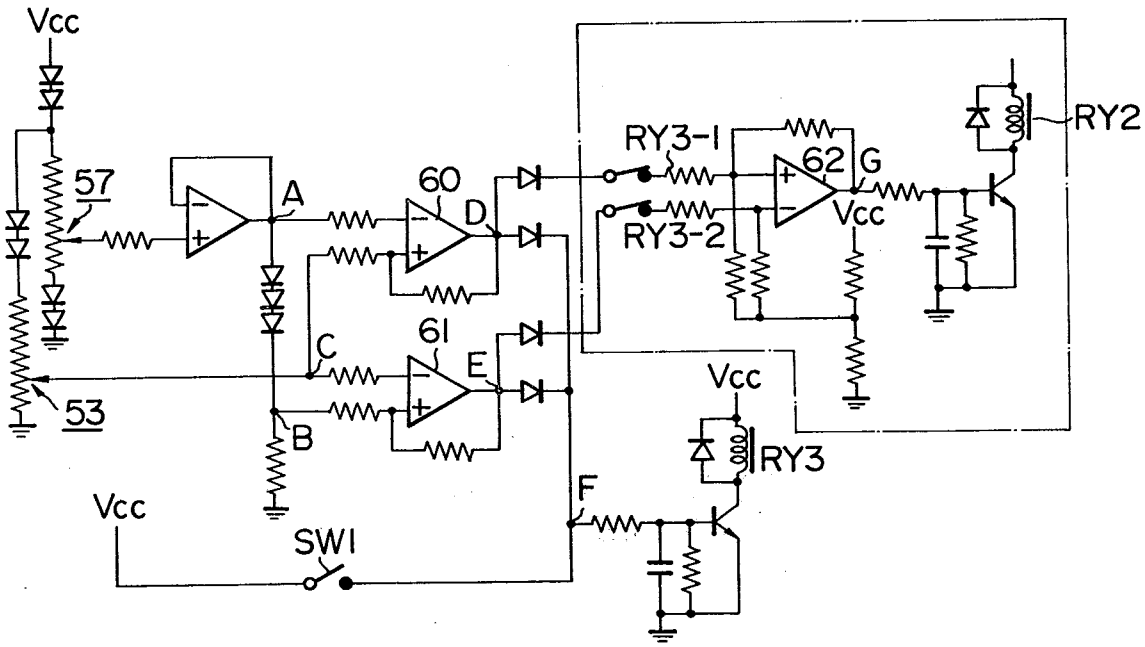
FIG. 8 is a diagram showing a circuit used together with the packaging paper selecting device of FIG. 7.

FIG. 7 shows another or second embodiment of the selecting mechanism and FIG. 8 shows its driving circuit. The selecting device of the second embodiment is substantially the same as that of the first embodiment except that the selecting device is provided with a locking mechanism. In this embodiment, the movable member 32 is provided with a plurality of circular projections extending sidewisely in an equally spaced relationship. The lever or stopper 39 is formed at one end thereof with a cut-out 66 which is engageable with one of the projections 65. A solenoid 68 is provided and a link 67 is connected between the stopper 39 and the solenoid 68. In operation, when a relay for solenoid RY3 is actuated by the setting of the setting dial, the solenoid 68 is energized to pull the link 67 and thus the stopper 39 is rotated clockwise to disengage the cut-out 66 from one of the projections 65. At the same time, a setting motor driving microswitch SW3 is released to issue a signal which starts to rotate the setting motor 45. The functions of the relay RY3 and its contacts RY3-1 and RY3-2 are the same as those of the relays RY1 and its contacts RY1-1 and RY1-2. Thereafter, just before the selection is completed, the D and E potentials become low in level and when the contact of the timing microswitch SW1 is opened, the relay RY3 is deenergized. In such a state, when one of the projections 65 and the cut-out 66 are completely engaged, the switch SW3 is actuated to stop the setting motor.

Figure 9:
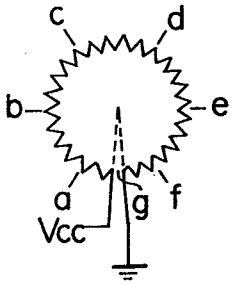
FIG. 9 is a diagram showing a potentiometer for use in a packaging paper selecting device.

The reason why the driving circuits in the embodiments are constructed so that the operational amplifier 62 is held to continue to energize the relay RY2 after the relay contacts RY1-1 and RY1-2 or relay contacts RY3-1 and RY3-2 which have given the indication of the direction of rotation to the operational amplifier are opened is in the following: In case that the setting potentiometer is rotated 60° to be set from a point to f point over its gap g (in the case of a one-revolution type potentiometer) as shown in FIG. 9, then if the above-mentioned construction were not adopted, the movable member 32 would be rotated 300° in the direction opposite to that of the setting dial due to the fact that a signal indicating direction toward lower potential is issued. On the other hand, in the present invention, since the signal indicating the direction toward higher potential is detected between a point and g point and is held in the operational amplifier 62, the movable member 32 is rotated 60° in the same direction as that of the setting dial.

Although in the first and second embodiment, the movable member 32 has been illustrated to be rotatable in either direction corresponding to the direction of rotation of the setting dial, the movable member can be constructed so that it can be rotated only in one direction regardless of the direction of rotation of the setting dial by abbreviating the rotating direction selecting circuit including the operation amplifier 25, the relay RY2 and the contacts RY1-1 and RY1-2 or RY3-1 and RY3-2 as shown in dotted lines of FIGS. 6 and 8.

What is claimed is:

1. A coin handling machine including an operation section having selectable movable members, further comprising:

a setting potentiometer including a movable member which is rotatable to designate coin species, and providing an output;

a selecting potentiometer including a movable member which is rotatable together with one of the selectable movable members in the operation section and providing an output;

control circuit means for detecting a differential potential between the respective outputs of the setting potentiometer and the selecting potentiometer to issue a driving signal and a rotating direction selecting signal;

driving circuit means connected to the control circuit means for receiving the driving signal and issuing a motor drive signal;

motor means connected to the driving circuit means for rotating the selectable movable members in the operation section in accordance with the motor drive signal; and rotating direction selecting circuit means connected to the control circuit means for receiving the rotating direction selecting signal and for determining the direction of rotation of the motor means in response to the rotating direction selecting signal before the driving circuit means receives the driving signal and for holding the rotating direction selecting signal constant once the driving circuit means receives the driving signal, wherein the driving circuit means comprises a motor driving relay having contacts through which the rotating direction selecting signal is transmitted to the rotating direction selecting circuit means and energized in response to the driving signal to open its contacts.

2. A coin handling machine as set forth in claim 1, further comprising at least one microswitch connected to said driving circuit means for applying another driving signal to said driving circuit means so that the motor is positively stopped when the differential potential between the output of the setting potentiometer and the output of the selecting potentiometer becomes zero, and wherein simultaneously the microswitch becomes open.

3. A coin handling machine as set forth in claim 1, wherein said one of said selectable movable members with which the movable member of the selecting potentiometer is rotated is a packaging paper selecting member which is adapted to carry a plurality of packaging paper thereon.

4. A coin handling machine as set forth in claim 3, wherein said packaging paper selecting member has engaging portions, said machine further comprising stopper means for stopping the packaging paper selecting member in a desired selected location by engaging one of the engaging portions thereof.

5. A coin handling machine as set forth in claim 4, wherein the stopper means loosely engages the packaging paper selecting member in stopping the same.

6. A coin handling machine as set forth in claim 5, wherein the stopper means rigidly engages the packaging paper selecting member with the aid of a locking device.

7. A coin handling machine as set forth in claim 1, wherein the movable member of the selecting potentiometer is rotatable in either direction, depending on the direction of rotation of a setting dial.

* * * * *